United States Patent [19]

Vulcano

[11] Patent Number: 4,697,486

[45] Date of Patent: Oct. 6, 1987

[54] BOOK COUNTER

[76] Inventor: Vincent Vulcano, 301 E. 48th St., Apt. 11G, New York, N.Y. 10017

[21] Appl. No.: 693,174

[22] Filed: Jan. 22, 1985

[51] Int. Cl.[4] ..... B26D 7/06; B65H 29/49

[52] U.S. Cl. ..... 83/79; 83/157; 83/167; 83/425; 83/925 MG; 209/583; 209/941

[58] Field of Search ..... 83/79, 106, 156, 157, 83/167, 169, 425, 925 MG; 209/564, 583, 584, 900, 941, 698

[56] References Cited

U.S. PATENT DOCUMENTS

| | | | |
|---|---|---|---|
| 3,087,612 | 4/1963 | Duncan et al. | 209/941 |
| 3,674,143 | 7/1972 | Hunter et al. | 209/941 |
| 3,808,931 | 5/1974 | Vulcano | 83/925 MG |
| 3,875,834 | 4/1975 | Vulcano | 83/925 MG |
| 4,432,458 | 2/1984 | Daboub | 209/564 |
| 4,447,715 | 5/1984 | Vulcano | 235/454 |

*Primary Examiner*—Frank T. Yost
*Assistant Examiner*—Hien H. Phan
*Attorney, Agent, or Firm*—Stephen E. Feldman

[57] ABSTRACT

Paperback books are fed one by one from a supply hopper to a stripper which separates the cover from the rest of the book and directs the book cover to a sorter; while directing the rest of the book for other disposition. A feed device receive each cover from the stripper and moves it to a sorter so that covers are spaced from each other a distance equal to the size of a bin of the cover sorter. Computer and electronic controls interconnect the supply feed, stripper and sorter, and include: a trigger, in the form of a notched wheel cooperating with a photocell circuit, to trigger required cover spacing; a senser to read UPC markings carried by the cover; and control and computer components to divert covers to appropriate sorting bins while counting the covers so sorted. Feed controls are provided to maintain cover feed through the sorter until all covers are sorted, even though feed of books from the supply hopper has ceased. A book pusher moves from the hopper into the path of a chain driven flight which pushes the book along the stripper path. A suction device separates the cover from the rest of the book and as the cover moves up a ramp and into a horizontal position a cutter wheel severs the cover from the rest of the book.

20 Claims, 11 Drawing Figures

BOOK
36
250
X
Y
30
32
50
70
72
74
76
78
80
86
88
90
122
140
144
146
192

COVER
90
BOOK
A
A
X
Y
30
32
34
36
37
38
50
70
82
84
90
100
102
104
106
108
120
122
124
250

BOOK COUNTER

BACKGROUND OF THE INVENTION

1. Field of Application

This invention relates to book counters and more particularly to equipment for counting books by sorting them according to information carried by the book's cover.

2. Description of the Prior Art

Books, particularly paperback books, are widely marketed today through a distribution network including bookstores, newstands, supermarkets, convenience stores and a myriad of other places accessible to a person interested in something to read. However, a goodly number of such books, following distribution to a place of sale, are returned to the wholesalers, jobbers, publisher, or other distributing organization. Once so returned a credit must be issued against the account of the party originally charged for the books. Such credits are usually made by accounting for the titles of the books returned for credit or other book carried information indicating the book's price. Magazines are distributed through identical and similar channels of trade; and are likewise returned for credit. As such, reference to paperback books will generally include magazines.

Returned paperback books are not always neatly arranged by title or price in another way that facilitates easy credit accounting. To sort such books by utilizing equipment shown and described in U.S. Pat. No. 3,414,126 to N. V. Vulcano for Book-Sorting Machine does not, however, fully solve all the problems in the trade. The large number of titles, prices, publishers, etc., and the extremely large number of books that are returned due to present distribution schemes has greatly complicated the accounting for returned paperback books. It is estimated that the number of returned paperback books runs into the hundreds of millions. As such many distributors do not return the books into the distribution network but destroy the books after the credit accounting process. Furthermore, the large number of books being returned would rapidly fill the sorting bins in equipment of the type shown in U.S. Pat. No. 3,414,126 and require fairly constant emptying of the bins.

An alternate approach to return book sorting and counting is provided in U.S. patent application Ser. No. 323,295 filed on Nov. 11, 1981 by Vincent N. Vulcano for "A Sorting Machine For Sorting Covers". This equipment sorts covers removed from books and obviates the need for return of the entire book. It also provides for shredding of the cover once counted. However, it is possible that all covers removed, and sent in for accounting, will not be properly stripped from the book and, as such, ragged edges and irregular tear lines may either slow down the sorting process or jam it up completely. In addition, the distributor may prefer or be otherwise required to retain the covers for auditing or futher accounting purposes.

SUMMARY OF THE INVENTION

It is therefore an object of this invention to provide a new and improved book counter.

It is another object of this invention to provide a new and improved book counter for paperback books.

It is yet another object of this invention to provide a new and improved book cover stripper.

It is still another object of this invention to provide a new and improved book cover stripper for paperback books.

It is yet still another object of this invention to provide a new and improved book cover sorter for paperback book covers.

It is still another object of this invention to provide a new and improved book cover stripper, sorter and counter.

It is yet still another object of this invention to provide a new and improved book cover stripper, sorter and counter for paperback books.

It is a further object of this invention to provide a new and improved stripper, sorter and counter for covers of "paperback" publications.

Other objects, features and advantages of the invention in its details of construction and arrangement of parts will be seen from the above, from the following description of the preferred embodiment when considered with the drawing and from the appended claims. In addition, these and other objects and advantages of the present invention will become evident from the description which follows.

BRIEF DESCRIPTION OF THE INVENTION

This invention involves book sorters, and contemplates; feeding paperback books from a horizontally disposed supply hopper to a stripper that separates the cover from the rest of the book, and which thereafter directs the stripped cover to a sorter, while directing the rest of the book into an appropriate receiving bin or towards equipment for further processing such as a shredder or other destruction device. As the cover moves into and through the sorter the UPC (Universal Product Code) carried thereby is sensed and the information derived therefrom is directed to a computer and associated electronic equipment for storage, sorter control, and accounting purposes. Thereafter, the sorter controls divert the cover to an appropriate storage bin. It should be understood, nevertheless, that without departing from the scope of this invention: that the supply hopper need not be horizontally disposed; that the UPC markings can be disposed upon either the front cover of the book cover of the book; that the covers once sorted can be directed to other appropriate receptacles; and that the items whose covers are to be stripped, sorted and accounted for may be magazines or other paperback publications.

The invention accordingly consists in the features of construction, combination of elements, and arrangement of parts which will be exemplified in the system, device, and article of manufacture hereinafter described, and of which the scope of application is as elucidated supra and as will be indicated in the appended claims. In this regard, numerous alternatives within the scope of the present invention, besides those alternatives, preferred embodiments or modes of practicing the invention supra, and those to be elucidated, infra, will occur to those skilled in the art.

BRIEF DESCRIPTION THE DRAWING

DESCRIPTION OF THE PREFERRED EMBODIMENT

Figure 1:
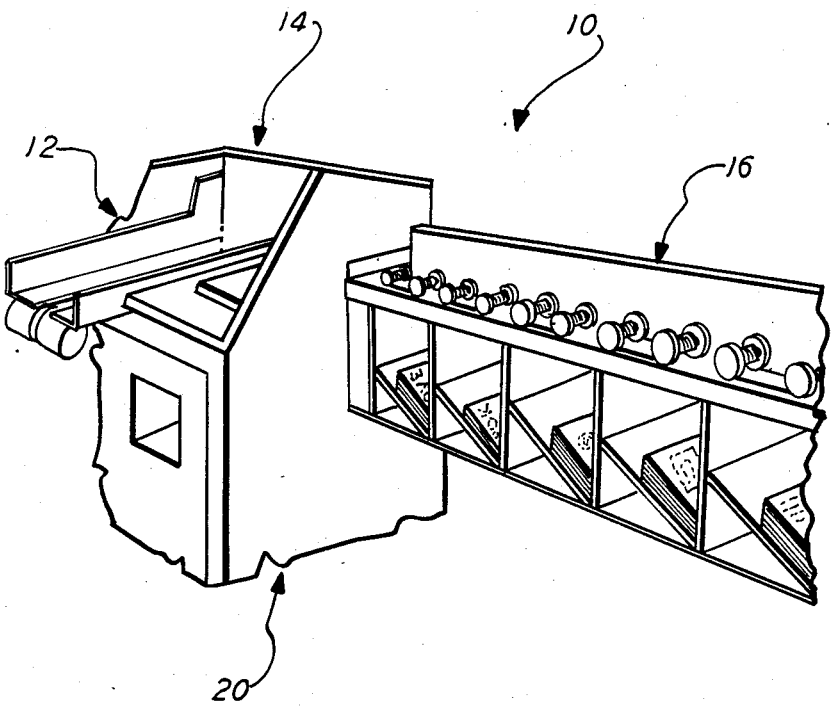
FIG. 1 is a schematic illustration of a book supply, stripper, sorter, and counter with associated computer and electronic controls for a book counter according to the instant invention.
Figure 4:
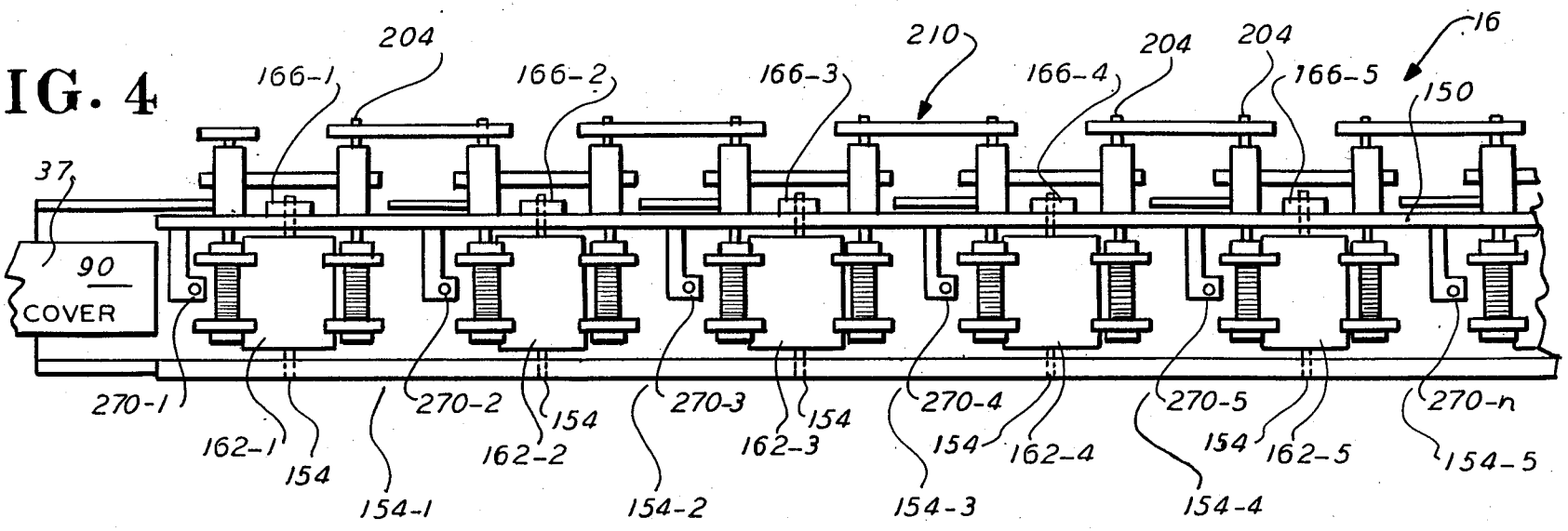
FIG. 4 is a plan view of the sorter section of the book counter of FIG. 1 with parts removed to better show details thereof.
Figure 5:
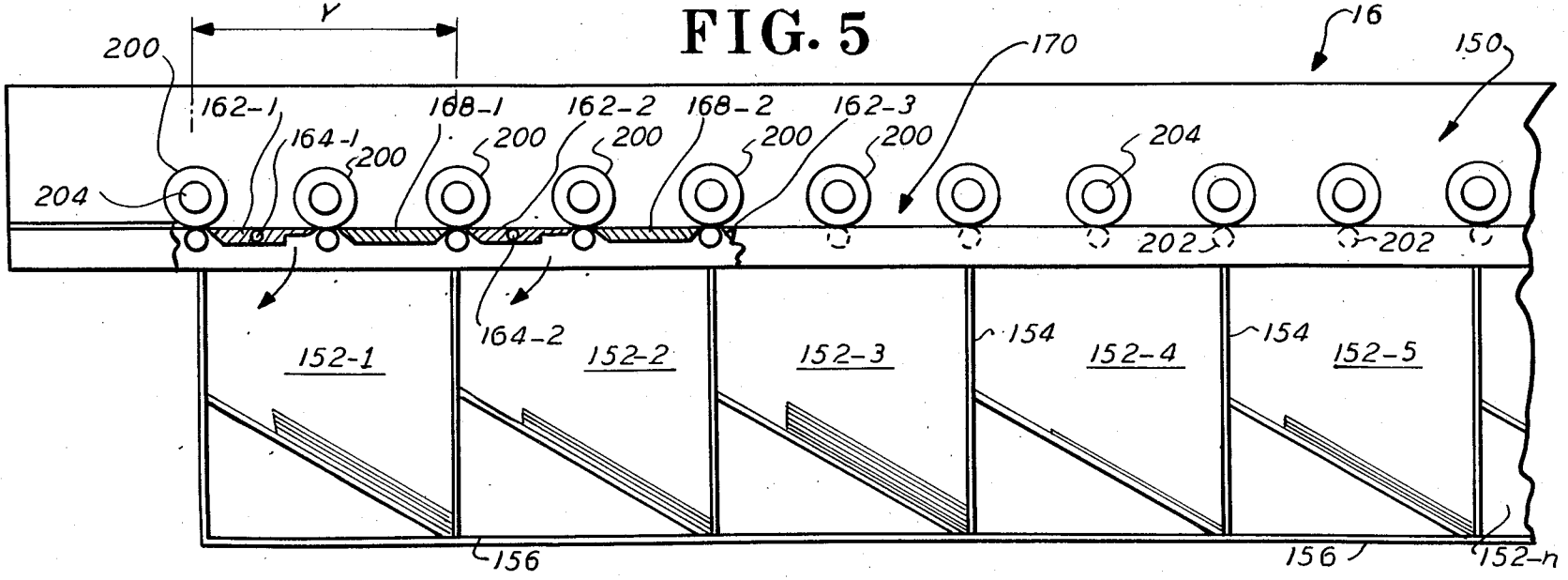
FIG. 5 is an elevational view of the sorter section of FIG. 4.

With reference to FIG. 1, there is generally shown at 10 a book counter including a supply section 12 (FIGS. 1–3), a stripper section 14 (FIGS. 1–3), and a sorter section 16 (FIGS. 1, 4 and 5) all interconnected through appropriate and conventional means (not shown) to computer and associated electronics and controls 20. Supply section 12 includes a supply hopper or magazine 30 (FIGS. 2 and 3) of tray like configuration having a bottom 32 and opposed side walls 34. Appropriate and conventional means (not shown) are provided to urge books 36 when disposed in hopper 30 towards a front end 38 thereof.

Figure 6:
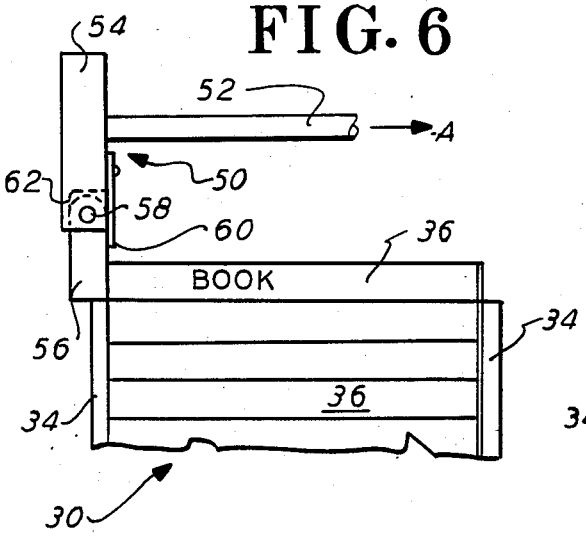
FIG. 6 is a schematic showing of the book pusher for the supply section of FIGS. 2 and 3 showing same about to push out a book from the supply hopper.
Figure 7:
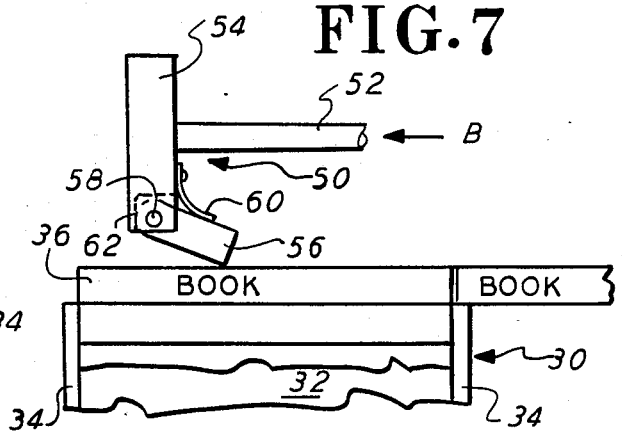
FIG. 7 is a schematic showing of the book pusher of FIG. 6 returning after pushing a book out of the supply hopper.

A book pusher 50 (FIGS. 2, 3, 6 and 7) is reciprocated in directions of arrow A (FIG. 6) and B (FIG. 7) to withdraw books 36 from hopper 30. A pusher rod 52 (FIGS. 6 and 7) of book pusher is, in turn, operated by conventional means such as an air cylinder or appropriate gearing (not shown) to effect such reciprocating movement. A mounting block 54, carried at the end of rod 52 carries a pivot piece 56 rockably mounted on a pivot pin 58 and urged by a flat spring 60 into a vertical disposition (FIG. 6). A lip 62 formed at the lower end of block 54 prevents rotation of pivot piece 56 past its vertical disposition of FIG. 6.

When rod 52 is drawn in the direction of arrow A (FIG. 6) it, in turn, moves block 54 and pivot piece 56 in the direction of arrow A. Pivot piece 56 contacts the end of book 36 and moves same in the direction of arrow A and into stripper section 14 of book counter 10. When book 36 has been completely removed from supply hopper 30 the book pusher mechanism therein advances all remaining books 36. Thus, when rod 52 is moved in the direction of arrow B (back to its initial position) end piece 56 engages lead book 36 and is rocked in the counterclockwise direction about pin 58 (FIG. 7) and against the action of spring 60. Piece 56 slides over book 36 until it passes the end thereof and then spring 60 returns piece 56 to its vertical disposition (FIG. 6) ready to withdraw the next book 36 from hopper 30.

Figure 3:
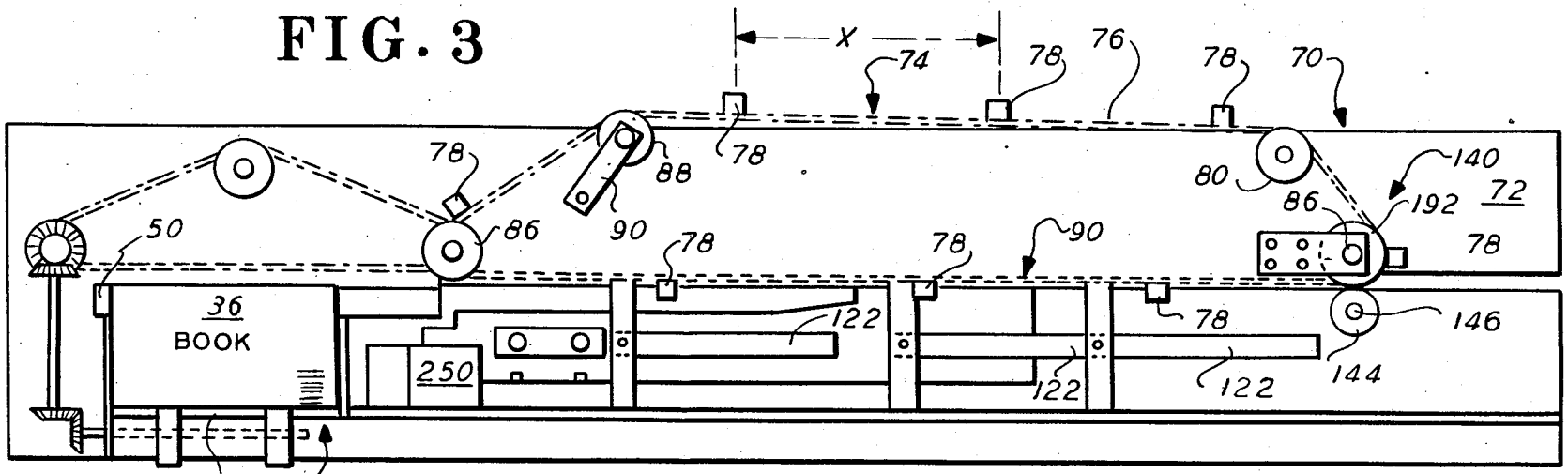
FIG. 3 is an elevational view of the supply and stripper section of FIG. 2.
Figure 2:
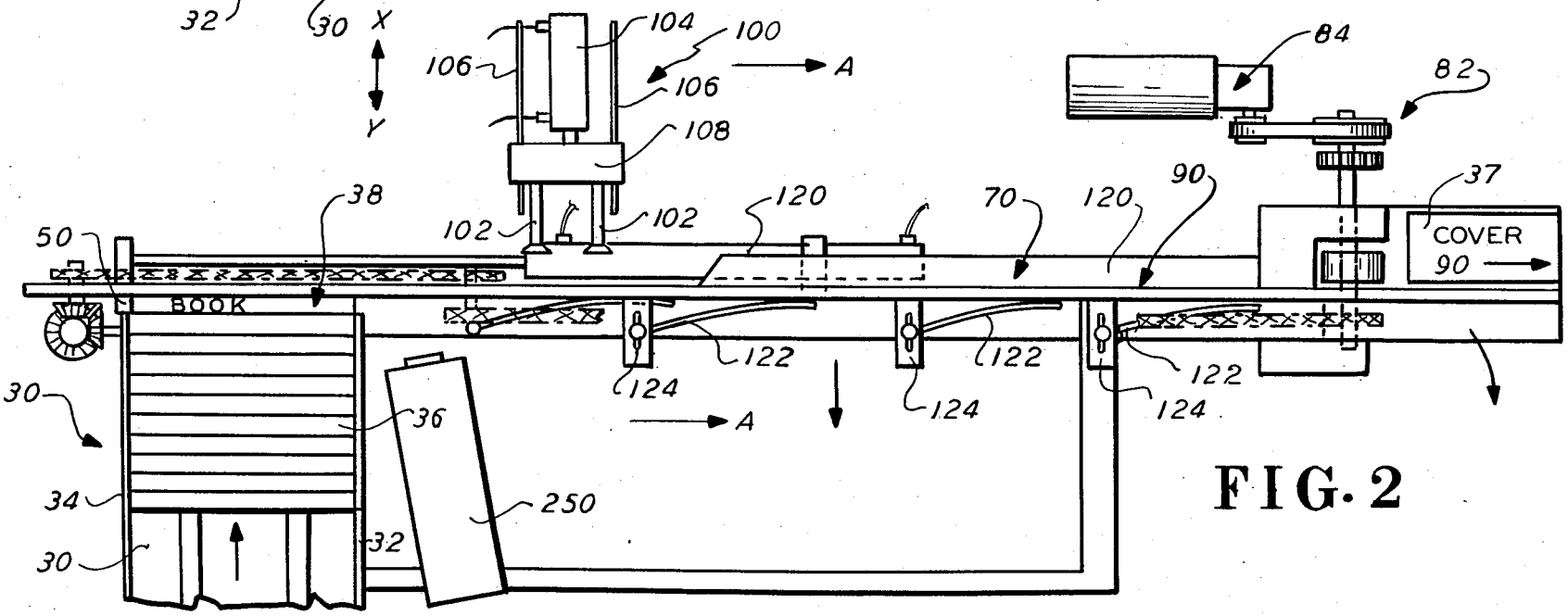
FIG. 2 is a plan view of the supply and stripper section of the book counter of FIG. 1 with parts removed to better show details thereof.

Supply section 12 and stripper section 14 are disposed proximate each other with their respective components mounted to support structure 70 (FIGS. 2 and 3). A rear wall 72 (FIG. 3) of support structure 70 mounts a book feeder 74 including a feeder chain 76 upon which there are disposed a number of feeder blocks or flights 78. A drive sprocket 80, driven through suitable gearing 82 and by a motor 84, meshes with drive chain 76 to drive same. A number of idlers 86, 88 suitably mounted to wall 72 serve to define a drive path for chain 76; with idler 88 being mounted on an arm 90 appropriately biased to maintain chain 76 taut.

Chain 76 is driven in the counterclockwise direction by sprocket 80 (FIG. 3) and as each block 78 engages a book 36, after it has been withdrawn from hopper 30, it will move book 36 in the direction of arrow A (FIG. 3) along a book stripper path 90. Blocks 78 are spaced a predetermined distance "x" apart for reasons to be explained hereinafter.

Figure 8:
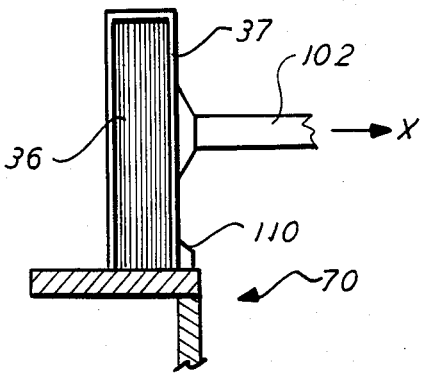
FIG. 8 is a schematic showing of the book cover lifter of the stripper section of FIGS. 2 and 3 showing same about to lift a book cover.
Figure 9:
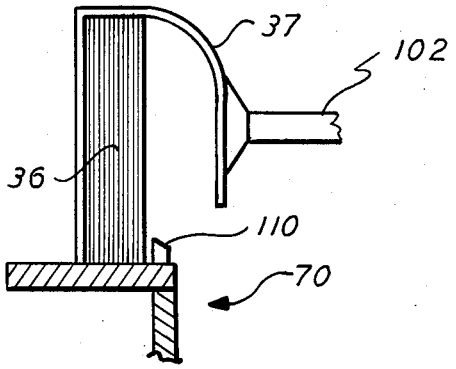
FIG. 9 is a schematic illustration of the book cover lifter of FIG. 8 showing same after a cover has been lifted.

A book cover lifter assembly 100 (FIG. 2) is disposed at the entry end of path 90. Lifter assembly 100 includes a pair of suction members 102 which are movable by appropriate reciprocating means 104 along a pair of guide rails 106 suitably carried by support structure 70. Suitable suction suppy means 108, of conventional construction, are provided for suction members 102. When a book 36 is moved by chain 76 along path 90 into alignment with suction members 102 (only one shown in FIGS. 8 and 9) its front cover 37 is moved proximate suction member 102 and suction is applied thereto. Movement of suction members 102 in the direction of arrow X (FIGS. 2 and 8) pulls cover 37 away from the rest of book 36 from the FIG. 8 position to the FIG. 9 position. Suction is thereafter cut off and cover 37 drops down due to gravity and its attachment to the rest of book 36. However, the open end of cover 37 is now disposed behind a lip 110 (FIGS. 8 and 9) and is spaced from the rest of book 36. The controls to be hereinafter described serve to time the application and cut-off of suction members 102 and the movement thereof in the direction of arrow X (FIG. 2) and return thereof in the direction of arrow Y to initial position.

Book 36 is, however, being moved along path 90 by chain 76 during the aforedescribed cover lifting. As book 36 continues to so move along path 90 it moves proximate a ramp means 120 (FIG. 2) which coacts with cover 37 now spaced by lip 110 from book 36 to urge and guide cover 37 into a horizontal disposition at an angle of 90° with respect to the rest of book 36. A number of leaf type spring fingers 122 mounted by mounting blocks 124 to wall 72 urge books 36 against a side of ramp means 120 while books 36 are moved by chain 76 along path 90.

Stripper section 14 also includes a cutter assembly 140 (FIG. 3) for separating cover 37 from the rest of book 36. A first cutter wheel 142 is mounted coaxially with idler sprocket 86 and driven thereby. A coacting cutter member 144 is rotatively carried by a stub shaft 146 carried by wall 72. Cutter assembly 140 is self sharpening and positioned to accurately sever book cover 37 from book 36 with a clean well defined edge. After cover 37 has been so severed it proceeds along feed path 90 into sorter section 16 (FIGS. 2 and 4–6). The rest of book 36 thereafter drops into an appropriately disposed bin or is moved by suitable equipment to a shredder or similar device.

Figure 10:
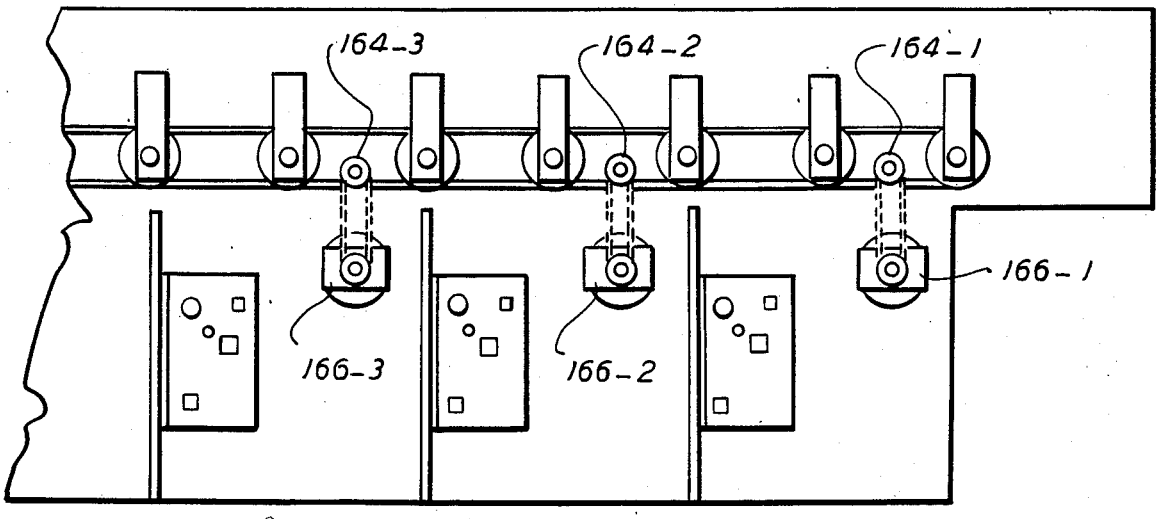
FIG. 10 is an elevational view of a section of the sorter section of FIGS. 4 and 5.

Sorter section 16 includes a support wall 150 which mounts a plurality of open faced sorting bins 152-1, 152-2, 152-3, etc., up to 152-n depending upon the number of sorts desired. Bins 152 are separated by separating walls 154 and share a common bottom wall 156. A pivoting diverter 162-1, 162-2, 162-3, etc., is provided atop each bin 152-1, 152-2, 152-3, etc., respectively; and mounted thereon upon pivot shafts 164-1, 162-2, etc., for rocking movement therewith. Diverter drivers 166-1, 166-2, etc., (FIGS. 4 and 10) actuated by conventional means and through controls as will be hereinafter explained are carried by support wall 150. Counting means of conventional construction are also suitably connected to control 20 to count the number of covers diverted into each bin 152.

Intermediate members 168-1, 168-2, etc., complete, with diverters 162-1, 162-2, etc., an upper running surface 170 which further defines path 90.

Driven feed wheels 200 and coacting feed idlers 202 propel book covers 37 along feed path 90. Drive shafts 204 for wheels 200 extend therethrough, through support wall 150 (FIGS. 4 and 5) to be driven by a drive sprocket and chain assembly 210 suitably powered and controlled by conventional means. Feed wheels 200 are driven so that as each cover 37 enters sorter section 16 it is accelerated and spaced from the succeeding cover by a predetermined spacing. In this instance the spacing between succeeding covers traveling along path 90 of sorter section 16 is selected so that each cover is spaced a distance "Y" from each other cover; the distance "Y" (FIG. 5) being equivalent to the spacing between two successive diverters 162. The reason for this will be hereinafter described.

A laser type scanner 250 (FIG. 2) is disposed in stripper section 14 proximate hopper 30 and positioned to sense and read UPC markings (not shown) disposed on the back cover of books 36 as they are withdrawn from hopper 30. Scanner 250 is appropriately mounted and suitably connected to the control and counting circuits as will be hereinafter explained. Other available scanners may just as easily be utilized for reading the UPC code markings or other type of markings carried by book 36. If such markings are carried by book cover 37, scanner 250 would be appropriately positioned.

A plurality of position of sensors 270-1, 270-2, 270-3, . . . 270-n are disposed along cover feed path 90 in sorter section 16 to sense the leading edge of book covers 37 as they move therealong. Sensors 270 are of conventional construction and are suitably interconnected into control circuit 20 by conventional means.

Figure 11:
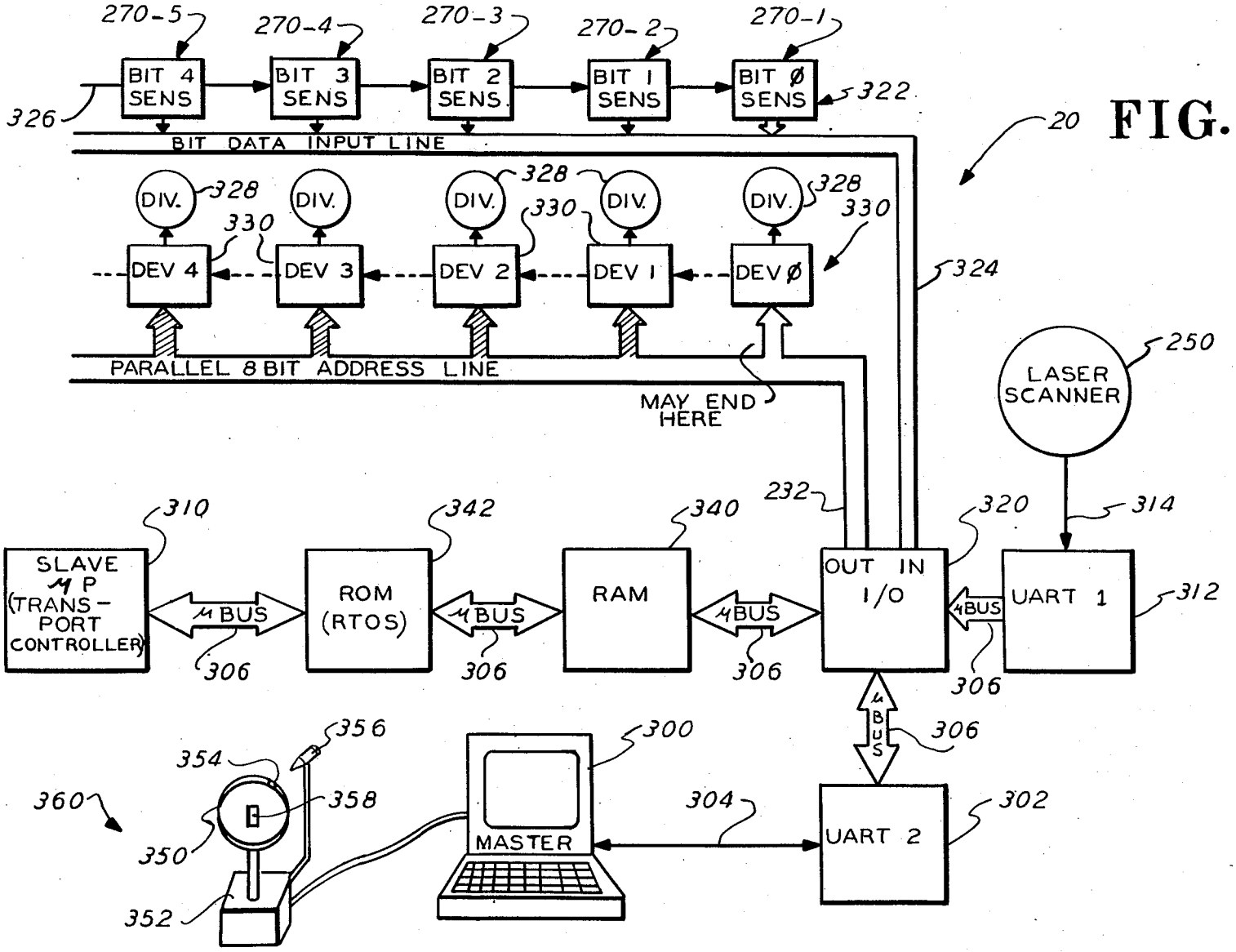
FIG. 11 is a schematic block diagram of the computer and associated electronics and other controls for the book stripper sorter and counter of FIG. 1.

Book counter 10, the feed of books 36 from hopper 30, the operation of book cover lifter assembly 100, the drive of book covers 37 along path 90 of sorter section 16 by feed wheels 200 and the timing and operation of diverters 162 and scanner 250 and all the other moving and coacting components coact and interrelate through computer and electronic control components 20 (FIGS. 1 and 11).

A master CPU 300 is provided to monitor and control housekeeping and utilities and is interconnected to a communications interface 302 by a suitable conductor 304; and through a micro-bus 306 interfaces master CPU 300 with a slave micro-processor or CPU 310. Slave micro-processor 310 (through suitable interconnections) controls the operations of stripper section 14, diverters 162 and processes the laser scanner input from the UART 2 communications interface 302. The data (CPU markings or other coding) sensed by laser scanner 250 is transmitted to a UART 1 communications interface 312 over a suitable communication line 314 and then to micro-bus 306.

An input/output device 320 handles the data input received from a plurality of position sensor inputs 322 (270-1 through 270-n) over an input communications line 324. Sensor inputs 322 are binary weighted (binary word 0–255). This is output to data line by bit-0 sensor 270-1 according to which sensor 270-1 is open or blocked. A look ahead line 326 is provided to be a decimal to binary converter. Input/output device 320 also handles transfer addresses to select proper diverters 162 to be operated, through diverter drivers 166 and is interconnected with a plurality of suitable and suitably disposed address decoders 330 (330-1; 330-n) over an output line 332. Address decoders 330 and drivers 328 can function similar to sensors 322.

A scratch pad memory RAM 340 in suitably provided and interconnected into control 20 to store quantities by title, bin number, price, etc.; while an ROM 342 is suitably provided and interconnected for diagnostics and to contain an operating system for stripper section 14.

Computer and electronic control 20 includes a wheel 350 suitably driven by a motor 352 and which includes a notch 354 disposed in the light path between a photocell 356 and a light source 358 which are suitably powered and which coact as a triggering device 360. Wheel 350 is driven by motor 352 to make exactly one revolution for each movement of a cover 37 a distance "y". In this instance distance "y" is equal to the size of a cover and is nine inches but other selected distances may be used. Triggering device 360 also functions to control feed of covers 37 into sorter section 16 so that covers 37 are spaced a distance "y" apart. To accomplish this feed of a cover 37 into sorter 16 is triggered by every two revolutions of wheel 350.

It will thus be seen that covers 37 will be spaced from each other by a distance "y". The size of bins 152 is selected to correspond to the size of covers 37. Distance "y" is selected so that all covers 37 moving through sorter section 16 will align successively with odd number bins 152-1, 152-3 etc., then with even number bins 152-2, 152-4 etc.; then repeating in alignment with odd then even, etc.. Computer and electronic control 20 is set up to read UPC markings, determine bin numbers, and operate diverter drivers 166 to operate diverters 162 to divert covers 37 for even bins during every even cycle (that is when covers 37 are aligned with bins designated even -2, -4, -6 etc). During the odd cycle (i.e. when covers 37 are aligned with bins designated odd -1, -3, -5 etc) control 20 operates diverter drivers 166 to operate diverters 162 to divert covers 37 into appropriate odd bins.

Computer and electronic control 20 will also keep the feed of feed wheels 200 operating even after books 36 are no longer being fed from storage section 12. Feed wheels 200 will continue to operate until the last cover 37 fed from stripper 140 has been sorted into its bin 152. Thereafter, book counter 10 can completely shut down.

It will thus be seen that computer 20 operates over a period of time sufficient to sort all stripped covers 37 and that such period of time includes a plurality of even cycles or first time intervals alternating with a plurality of odd cycles or second time intervals.

As various possible embodiments might be made of the above invention, and as various changes might be made in the embodiments above set forth, it is to be understood that all matter herein described and shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is:

1. A book counter; comprising:

(a) book supply means;

(b) feed means for feeding books one by one from said book supply means;

(c) cover stripper means disposed to receive books as they are fed from said book supply means and coacting with each book so received to strip a cover from the book;

(d) cover sorter means disposed to receive covers from said cover stripper means and to coact with the covers so received to move the covers along a predetermined cover sorting path with a predetermined spacing between each cover;

(e) sensing means disposed proximate said cover sorting path to sense for predetermined indicia when carried by the cover;

(f) said cover sorting means including a plurality of cover sorting bin means, disposed proximate said cover sorting path and so as to receive covers therefrom;

(g) said plurality of cover sorting bin means including a plurality of first bin means and a plurality of second bin means;

(h) said cover sorting means also including cover diverter means for selectively moving covers from said cover sorting path into selected ones of said cover sorting bin means;

(i) computer and electronic control means for operating the book counter for a predetermined time period;

(j) said predetermined time period including a plurality of even cycles which occur during first time intervals, and a plurality of odd cycles which occur during second time intervals; and (k) said computer being interconnected with and controlling operation of said feed means and said cover stripper means so that when predetermined indicia are sensed first selected ones of said covers are diverted by said cover diverter means into selected ones of said plurality of first bin means during said even cycles which occur during said first time intervals and second selected ones of said covers are diverted by said cover diverter means into selected ones of said plurality of second bin means during said odd cycles which occur during said second time intervals.

2. The book counter of claim 1, wherein said first time interval during the operation of the book counter occurs when the covers are aligned with bin means disposed in "even" positions counting from a first one of said bin means.

3. The book counter of claim 2, wherein said second time interval during operation of the book counter occurs when the covers are aligned with bin means disposed in odd positions counting from said first one of said bin means.

4. The book counter of claim 1, wherein said computer and electronic control means maintains feed of covers through said cover sorter means after termination of feed of books from said book supply means and until all covers are sorted.

5. The book counter of claim 1, wherein said computer and electronic control means includes trigger means for controlling the movement of covers from said cover stripper means to said cover sorter means.

6. The book counter of claim 5, wherein said trigger means includes a marked wheel driven by motor means and sensing means for sensing the mark on said wheel and for controlling feed of covers to said sorting means in response thereto.

7. The book counter of claim 6, wherein said mark on said wheel includes a notch and said mark sensing means includes photocell means including a light source.

8. The book counter of claim 1, wherein said predetermined indicia is universal product code markings.

9. The book counter of claim 1, wherein said predetermined spacing of the covers is substantially equal to the size of each of said bin means.

10. The book counter of claim 9, wherein said predetermined spacing of the covers is nine inches.

11. The book counter of claim 1, wherein said cover stripper means includes book drive means to drive a book, fed by said feed means for feeding books from said book supply means, along a stripper path to a cover severing device.

12. The book counter of claim 11, wherein said book drive means includes a plurality of spaced flights driven by said book drive means so as to contact a book feed from said book supply means to move the book along said stripper path.

13. The book counter of claim 12, wherein said book drive means includes at least one sprocket coacting with a chain to drive said chain; said flights being carried by said chain.

14. The book counter of claim 13, wherein said cover stripper means includes suction means disposed proximate a book as it is fed from said book supply means to suck the book cover away from the rest of the book; and spacer means to keep the cover so spaced as the book moves along the stripper path.

15. The book counter of claim 14 including orientation means disposed along said stripper path and coacting with a book and its cover when moving therealong to orient the book cover at a predetermined angle with respect to the rest of the book.

16. The book counter of claim 15, wherein said orientation means includes a ramp disposed for coaction with the book and cover as they move along said stripper path to so orient the book and its cover.

17. The book counter of claim 16, wherein said predetermined angle is 90 degrees.

18. The book counter of claim 17, wherein the book is vertically disposed and the cover is horizontally disposed.

19. The book counter of claim 15 including cutter wheel means disposed along said stripper path and coacting with the book and its cover after they are so oriented to sever the cover from the book.

20. The book counter of claim 19, wherein said cutter wheel means includes a driven cutter wheel and coacting opposing wheel.

* * * * *